US008185175B2

(12) United States Patent
Kobayashi

(10) Patent No.: US 8,185,175 B2
(45) Date of Patent: May 22, 2012

(54) SUPERCONDUCTING COIL AND SUPERCONDUCTOR USED FOR THE SAME

(75) Inventor: Shinichi Kobayashi, Osaka (JP)

(73) Assignee: Sumitomo Electric Industries, Ltd., Osaka-shi, Osaka (JP)

( * ) Notice: Subject to any disclaimer, the term of this patent is extended or adjusted under 35 U.S.C. 154(b) by 251 days.

(21) Appl. No.: 12/373,966

(22) PCT Filed: Apr. 9, 2008

(86) PCT No.: PCT/JP2008/056977

§ 371 (c)(1),
(2), (4) Date: Jan. 15, 2009

(87) PCT Pub. No.: WO2008/133003

PCT Pub. Date: Nov. 6, 2008

(65) Prior Publication Data

US 2010/0029487 A1 Feb. 4, 2010

(30) Foreign Application Priority Data

Apr. 17, 2007 (JP) ..... 2007-107711

(51) Int. Cl.
*H01F 6/06* (2006.01)
*H01B 12/02* (2006.01)

(52) U.S. Cl. ..... 505/211; 505/705; 505/844; 505/879; 335/216; 335/296; 324/318

(58) Field of Classification Search ..... 505/230, 505/231, 430, 431, 433, 470, 703, 704, 705; 335/216–218; 174/125.1; 29/599
See application file for complete search history.

(56) References Cited

U.S. PATENT DOCUMENTS

2004/0082482 A1* 4/2004 Rey ..... 505/100
2005/0028347 A1* 2/2005 Maher ..... 29/592.1

FOREIGN PATENT DOCUMENTS

| | | |
|---|---|---|
| JP | 03-108704 | 5/1991 |
| JP | 04 324209 | * 11/1992 |
| JP | 05-135935 | 6/1993 |
| JP | 06-243737 | 9/1994 |
| JP | 10-104911 | 4/1998 |
| JP | 2007-081254 | 3/2007 |

OTHER PUBLICATIONS

Naoki Ayai et al., "Achievement of HTS Wire Critical Exceeding 200 A", SEI Technical Review, Jul. 2006, No. 169, pp. 103-108, Including English language abstract.
Munetsugu Ueyama et al., "Development of HoBCO Coated Conductor", SEI Technical Review, Jul. 2006, No. 169, pp. 109-112, Including English language abstract.

* cited by examiner

*Primary Examiner* — Stanley Silverman
*Assistant Examiner* — Kallambella Vijayakumar
(74) *Attorney, Agent, or Firm* — Drinker Biddle & Reath LLP

(57) ABSTRACT

A low-cost superconducting coil which can generate a high magnetic field at comparatively high temperature is provided. The superconducting coil is formed in a pancake shape by winding a superconducting conductor that is made by electrically connecting a tape-shaped (Bi,Pb)2223 superconducting wire and a tape-shaped RE123 superconducting wire in series such that the tape-shaped (Bi,Pb)2223 superconducting wire is arranged in the outer circumferential part and the tape-shaped RE123 superconducting wire is arranged in the internal circumferential part.

6 Claims, 7 Drawing Sheets

SUPERCONDUCTING COIL AND SUPERCONDUCTOR USED FOR THE SAME

TECHNICAL FIELD

The present invention relates to a superconducting coil, and more particularly to a structure of superconducting coil that is capable of generating a high magnetic field at high operation temperature.

BACKGROUND ART

As for superconducting wires using oxide superconducting materials, there are the following two kinds that are under intensive development at present: one is a tape-shaped silver sheathed superconducting wire made by a powder-in-tube method and having $(Bi,Pb)_2Sr_2Ca_2Cu_3O_{10}\pm\delta$ phase as a main component ($\delta$ is a number on the order of 0.1: hereinafter, referred to as (Bi,Pb)2223). (For example, refer to Non-patent Document 1.) The other one is a tape-shaped thin-film superconducting wire in which a superconducting layer is formed on a metallic substrate by a vapor-phase method or a liquid phase method. The superconducting material of the thin-film superconducting wire is an oxide superconducting material represented by the chemical formula of $RE_1Ba_2Cu_3O_x$ (x is a number which is near 7; hereinafter, referred to as RE123), and in the RE (Rare Earth) part one element or compound of rare-earth elements such as Y, Ho, Nd, Sm, Dy, Eu, La, Tm, etc. is arranged. (For example, refer to Non-patent Document 2.)

A superconducting coil is produced using the above-mentioned superconducting wires for the purpose of a magnetic field application. Patent Document 1 discloses a superconducting coil that is made by stacking a plurality of pancake coils using tape-shaped (Bi, Pb)2223 superconducting wires. The superconducting coil made of the tape-shaped (Bi,Pb) 2223 superconducting wires is cooled to a low temperature of 20 K or less, and a magnetic field is generated by flowing a given operating current.

The tape-shaped (Bi,Pb)2223 superconducting wire is not so strong in terms of resistance to a magnetic field at high temperature, and the critical-current value tends to be degraded when the superconducting wire is placed in the magnetic field. Therefore, when the (Bi,Pb)2223 superconducting wire is in a shape of coil, the critical-current value decreases due to a magnetic field generated by itself. As a countermeasure, therefore, the critical-current value is made larger beforehand by lowering the operation temperature so that a sufficient electric current may flow through the coil under the generated magnetic field. Thus, if a comparatively large magnetic field is to be generated in a superconducting coil in which the tape-shaped (Bi,Pb)2223 superconducting wire is used, the coil is cooled to a low temperature of about 20 K. Therefore, for cooling the superconducting coil, it is necessary to use equipment that is capable of cooling to a low temperature of about 20 K.

On the other hand, the tape-shaped RE123 superconducting wire is superior to the tape-shaped (Bi,Pb)2223 superconducting wire in terms of the resistance to a magnetic field, and the degradation of the critical-current value is small under the relatively high temperature in the magnetic field. However, the tape-shaped RE123 superconducting wire, the manufacturing process of which is complicated and delicate, is difficult to make a long length of uniform wire that can be formed into a coil with a single length thereof. Also, the wire cost is high because of the low yield.

[Patent Document 1] Japanese Patent Application Publication No. H10-104911

[Non-patent Document 1] SEI Technical Review No. 169 issued in July 2006, pp. 103-108

[Non-patent Document 2] SEI Technical Review No. 169 issued in July 2006, pp. 109-112

DISCLOSURE OF INVENTION

Problems to be Solved by the Invention

An object of the present invention is, in view of the above-mentioned situations, to provide a low-cost superconducting coil and a superconducting conductor to be used therein, with which a high magnetic field can be generated at comparatively high temperature, that is, by using cooling equipment of relatively low cooling capacity.

Means for Solving the Problem to be Solved

The present invention that can solve the above-mentioned problems was made by investigating the characteristics of tape-shaped (Bi,Pb)2223 superconducting wires and tape-shaped RE123 superconducting wires in detail, and by combining the features of those wires. Hereinafter, the present invention will be described.

The present invention is a superconducting coil having a pancake shape formed by winding a superconducting conductor that is made by electrically connecting a tape-shaped (Bi,Pb)2223 superconducting wire and a tape-shaped RE123 superconducting wire in series, such that the tape-shaped (Bi,Pb)2223 superconducting wire is arranged in the outer circumferential part while the tape-shaped RE123 superconducting wire is arranged in the internal circumferential part.

In the present invention, preferably the width of the tape-shaped (Bi,Pb)2223 superconducting wire and the width of the tape-shaped RE123 superconducting wire are equal.

In the present invention, preferably the tape-shaped RE123 superconducting wire is arranged such that a conductor, which is formed by electrically connecting the tape-shaped (Bi,Pb)2223 superconducting wire and the tape-shaped RE123 superconducting wire in series, is wound in such a manner as the winding diameter of the tape-shaped RE123 superconducting wire includes all the inner circumferential part that is less than the allowable bending diameter of the tape-shaped (Bi,Pb)2223 superconducting wire.

Also, the superconducting conductor of the present invention is a superconducting conductor which is used in either one of the above-mentioned superconducting coils.

Advantageous Effect of the Invention

According to the present invention, a low-cost superconducting coil in which a high magnetic field can be generated at comparatively high temperature can be realized.

Figure 1:
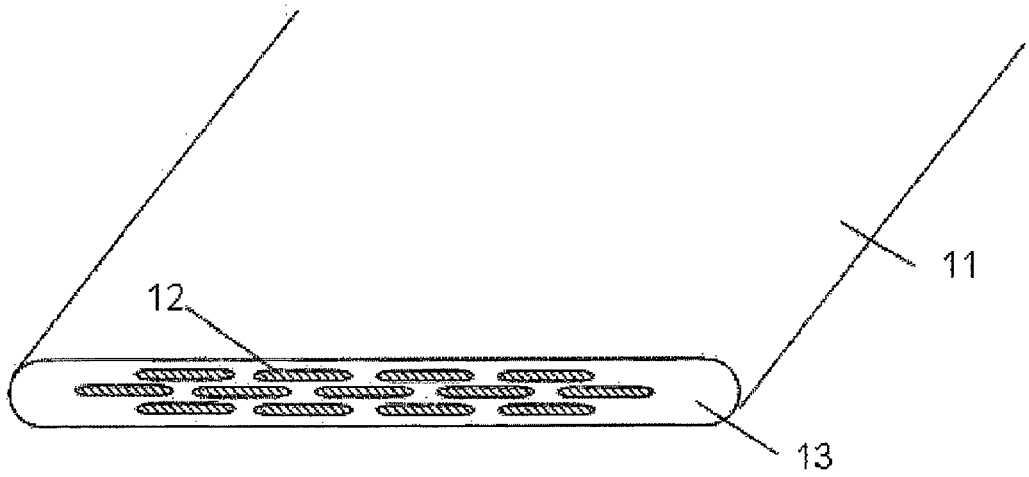
FIG. 1 is a partial sectional perspective view schematically showing a structure of the tape-shaped (Bi,Pb)2223 superconducting wire.

| Description of referenced numerals | |
|---|---|
| 11 | oxide superconducting wire |
| 12 | oxide superconducting filament |
| 13 | sheath portion |
| 20 | tape-shaped RE123 superconducting wire |
| 21 | textured metal substrate |
| 22 | buffer layer |
| 23 | superconducting thin-film layer |
| 24 | stabilizing layer |
| 25, 26 | protective layer |
| 41 | superconducting coil |
| 42 | terminal |
| 43 | persistent-current switch |
| 71, 72, 73, 74, 75, 76, 77 | superconducting coil |

BEST MODE FOR CARRYING OUT THE INVENTION

Hereinafter, preferred embodiments of the invention will be described. The dimensional ratios in the drawings do not always agree with those in the description.

Embodiment

FIG. 1 is a partial sectional perspective view schematically showing a structure of the tape-shaped (Bi,Pb)2223 superconducting wire. In reference to FIG. 1, the tape-shaped (Bi,Pb)2223 superconducting wire having a number of filaments will be explained. A tape-shaped (Bi,Pb)2223 superconducting wire 11 has a plurality of (Bi,Pb)2223 superconductor filaments 12 extending in a longitudinal direction and a sheath portion 13 covering them. The material of the sheath portion 13 is composed of, for example, metal such as silver and silver-based alloy.

Figure 2:
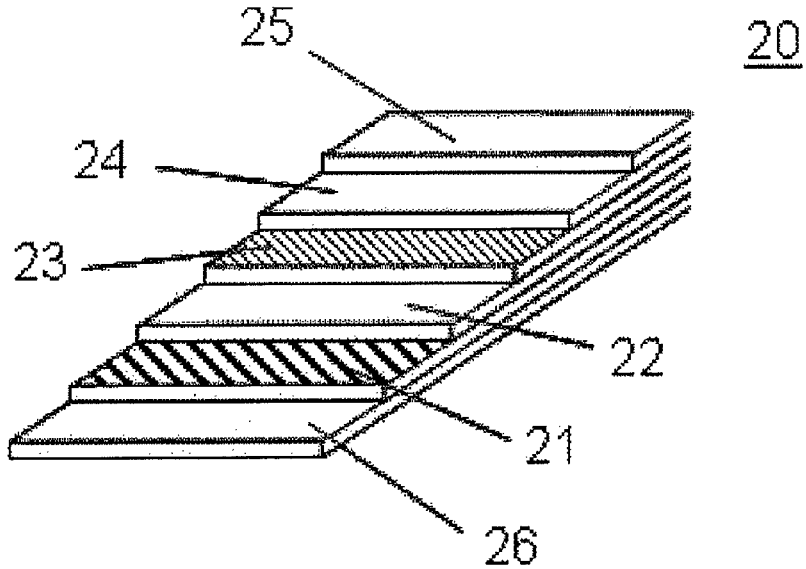
FIG. 2 is a partial section perspective view schematically showing a structure of the tape-shaped RE123 superconducting wire.

FIG. 2 is a partial sectional perspective view schematically showing a structure of the tape-shaped RE123 superconducting wire. In reference to FIG. 2, a typical tape-shaped RE123 superconducting wire will be explained. A tape-shaped RE123 superconducting wire 20 comprises a textured metal substrate 21 as the substrate, a buffer layer 22 formed on the textured metal substrate 21, a superconducting thin-film layer 23 formed on the buffer layer 22, a stabilizing layer 24 to protect the superconducting thin-film layer 23, and protective layers 25, 26 to protect the whole and to improve conductivity.

The textured metal substrate 21 may be a Ni textured substrate, a Ni-alloy textured substrate, or the like, for example. The buffer layer 20 may be made of, for example, an oxide such as $CeO_2$ or YSZ (yttrium-stabilized zirconia). As for the superconducting thin-film layer 23, an RE123-based superconducting material such as $HoBa_2Cu_3O_x$ (x is a number that is near 7) can be chosen, for example. The stabilizing layer 24 and the protective layers 25 and 26 may be made of Ag (silver) or Cu (copper).

Figure 3:
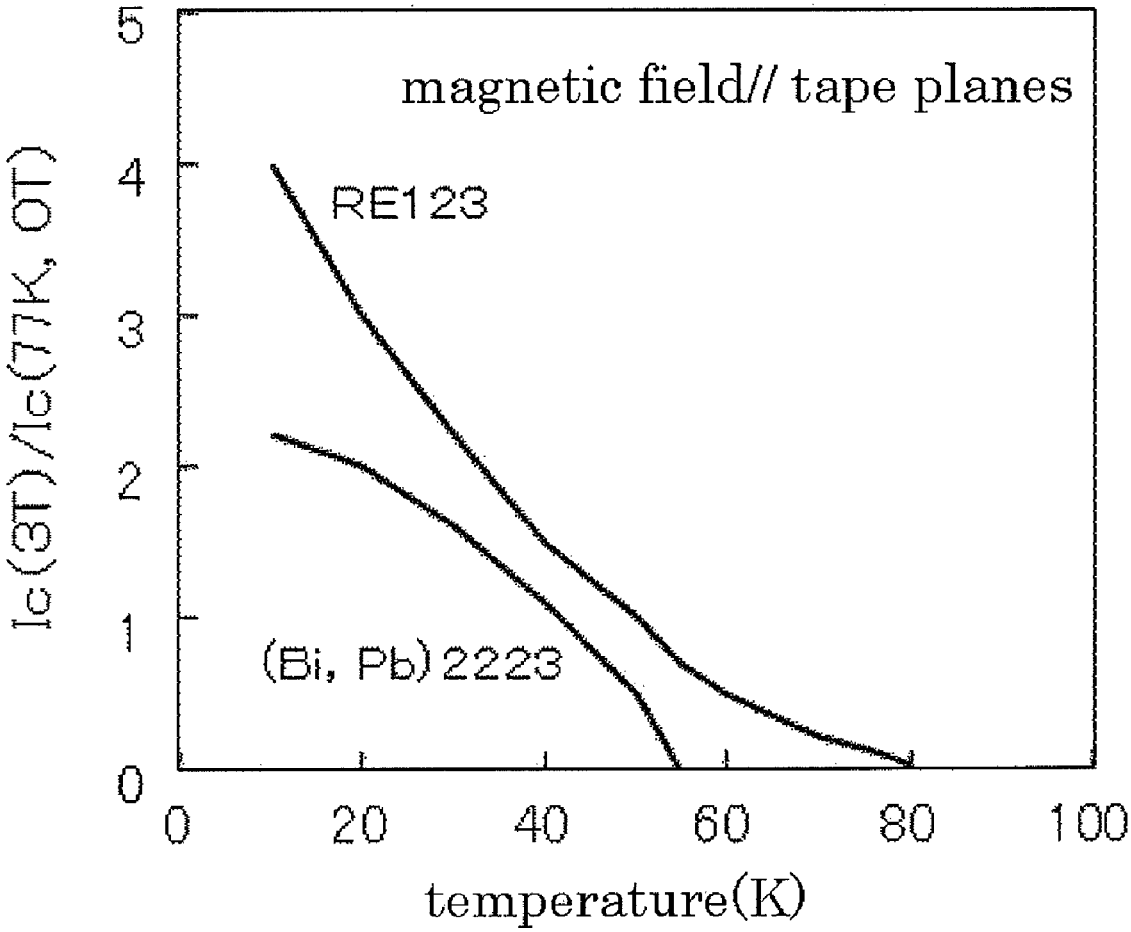
FIG. 3 is a graph showing temperature-critical current characteristics of a (Bi,Pb)2223 superconducting wire and an RE123 superconducting wire in a magnetic field.

FIG. 3 is a graph showing temperature-critical current characteristics of a tape-shaped (Bi,Pb)2223 superconducting wire and a tape-shaped RE123 superconducting wire in a magnetic field. In the figure, the variation of the critical-current value (Ic(3 T)/Ic(77 K, 0 T)) is plotted in the case where a magnetic field of 3 T is applied to the respective tape planes in parallel, where the critical-current value in the zero magnetic field at a liquid-nitrogen temperature (77 K) is 1. For example, if the critical-current value at the 77 K and zero magnetic field is 100 A, and if a plotted point lies at a position of 2 on the ordinate, it shows the fact that a critical current of 200 A flows at the temperature in the magnetic field of 3 T.

In either one of the superconducting wires, the critical-current value increases according to the decrease of temperature; however, the increase of the critical-current value of the tape-shaped RE123 superconducting wire is larger. Also, in the case of the tape-shaped (Bi,Pb)2223 superconducting wire, the critical-current value becomes substantially 0 at 50 to 60 K. It is seen that the tape-shaped RE123 superconducting wire has a superior critical current characteristic in the magnetic field.

For example, when it is attempted to form a superconducting coil in which a magnetic field of 3 T is applied to the tape plane in parallel at an operating temperature of 60 K, it cannot be achieved if the tape-shaped (Bi,Pb)2223 superconducting wire is used, because the critical-current value is 0 under the above-mentioned conditions. On the other hand, with the tape-shaped RE123 superconducting wire, the above-mentioned superconducting coil can be formed because the RE123 superconducting wire has a finite critical temperature under the same conditions.

Also, at a temperature of 50 K or less, with the tape-shaped (Bi,Pb)2223 superconducting wire, it is possible to form a superconducting coil that is the same as the above-described one (the magnetic field of 3 T is applied in parallel to the tape plane). Of course, it can also be made with the tape-shaped RE123 superconducting wire. If a coil is formed with the tape-shaped (Bi,Pb)2223 superconducting wire, which is capable of flowing a small electric current, the number of winding must be increased because a generated magnetic field depends on the product of the flowing electric current and the number of winding. This results in increase of the outer diameter of the coil. In such case, a refrigerator used for cooling the coil having such a large diameter must have a high cooling capacity.

Also, in addition to the superconducting property in the magnetic field, when the tape-shaped (Bi,Pb)2223 superconducting wire and the tape-shaped RE123 superconducting wire are compared, the tape-shaped RE123 superconducting wire has the following advantages. One advantage is that it has less tendency of decrease in critical current value when it is bent at a smaller curvature. In other words, it allows a smaller winding diameter. Another advantage is that it has stronger resistance to tensile force applied from the outside. In a superconducting coil, the superconducting wire suffers from a hoop power (tensile force) due to electromagnetic force. If this power is large, the superconducting part of the wire may occasionally be destroyed. In the case of the tape-shaped RE123 superconducting wire, the textured metal substrate 21 also functions as a reinforcement material, and therefore it can withstand large tensile force.

It is possible to form a high performance superconducting coil with the tape-shaped RE123 superconducting wire that exhibits good performance in the magnetic field. However, as described above, it is difficult to form a long uniform wire that can be used for making a coil with a single length, because the process of making the tape-shaped RE123 superconducting wire is complicated and delicate. Also, the wire cost tends to be high due to the low yield.

On the other hand, the tape-shaped (Bi,Pb)2223 superconducting wire also has an advantage. That is, since the whole wire is covered with silver or silver-based alloy having good thermal conductivity, the cooling can be achieved easily as compared with the tape-shaped RE123 superconducting wire.

Therefore, in the present invention, a superconducting coil is formed by electrically connecting the tape-shaped (Bi,Pb) 2223 superconducting wire and the tape-shaped RE123 superconducting wire in series as a superconducting conductor, taking advantage of their respective merits.

Figure 4:
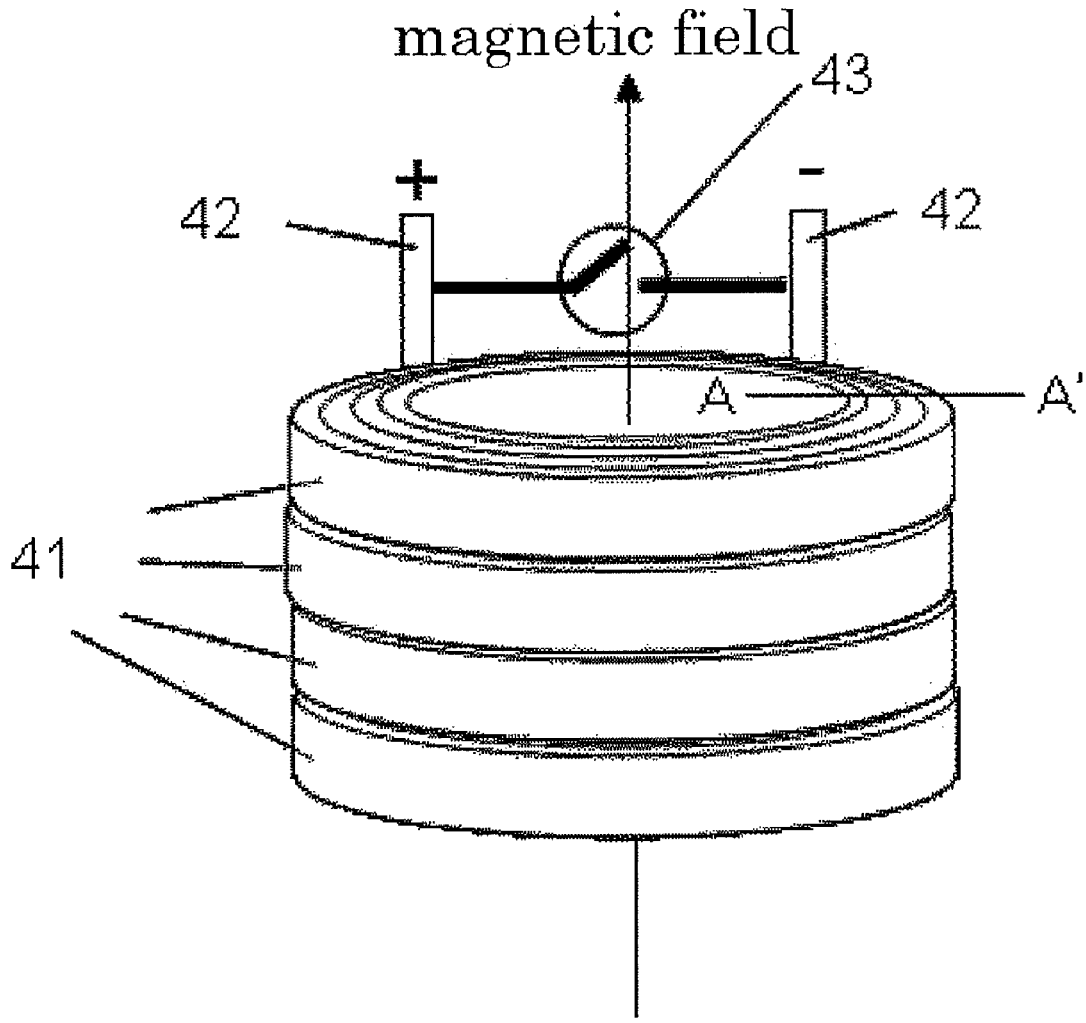
FIG. 4 is a schematic diagram showing an example of a typical superconducting magnet.

FIG. 4 is a schematic diagram showing an example of a typical superconducting magnet. A superconducting coil 41 is formed by winding a superconducting wire in a pancake shape. The superconducting coils 41 thus made are electrically connected as needed in according to the intended use. When an electric current is supplied from a terminal 42 into the superconducting coils 41, a magnetic field occurs in these coils. Also, when the terminals 42 are connected together through a persistent-current switch 43 made of an oxide superconducting wire and excitation is done to the target magnetic field, and thereafter the persistent-current switch 43 is switched on, an eternal electric current flows in the loop of the superconducting coil 41—the persistent-current switch 43.

Figure 5:
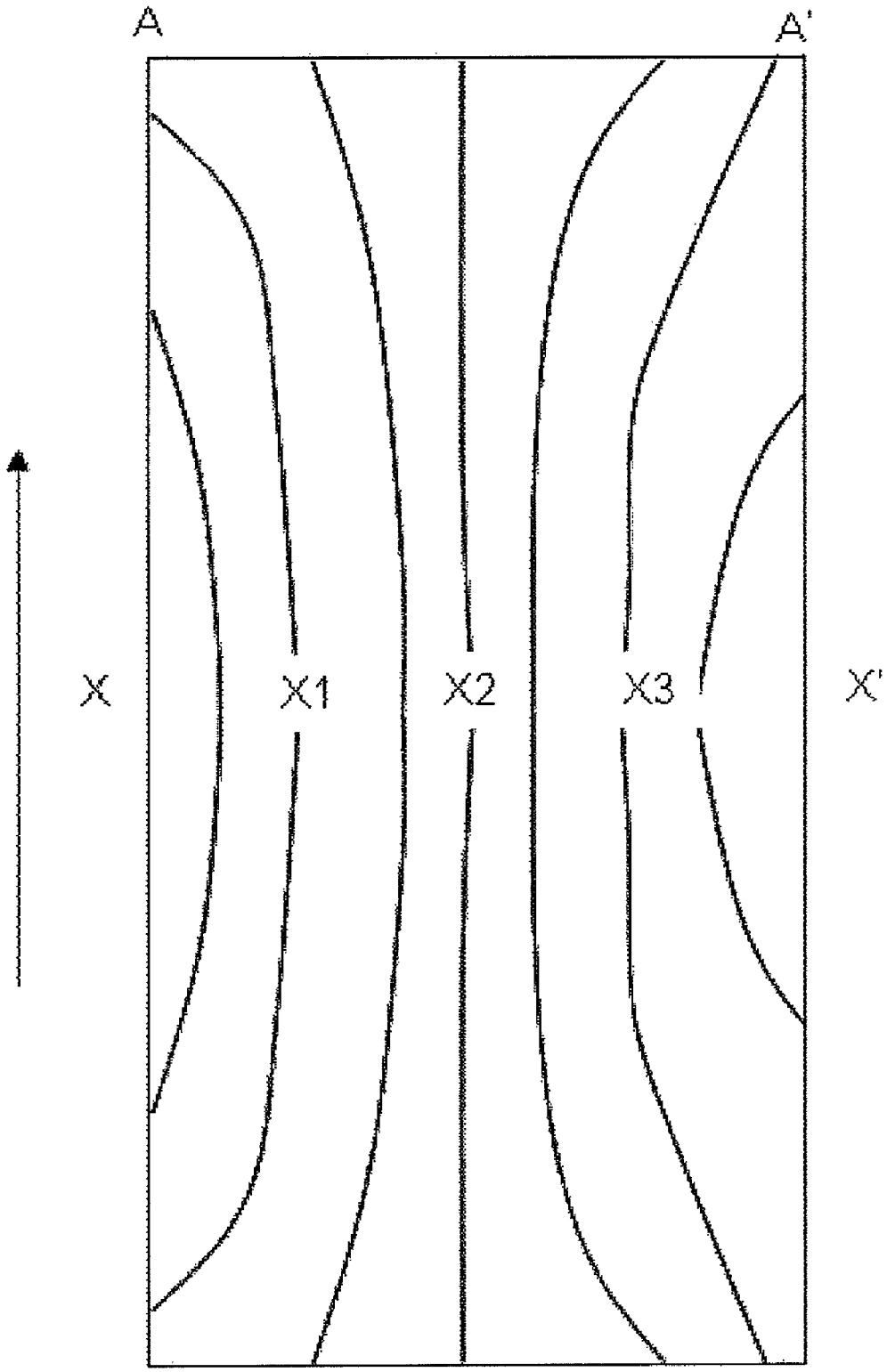
FIG. 5 is a schematic diagram showing a magnetic field strength distribution in the A-A' section of FIG. 4 in the case where an electric current is supplied to the superconducting coils.

FIG. 5 is a schematic diagram showing a magnetic field strength distribution in the A-A' section of FIG. 4 in the case where an electric current is supplied to the superconducting coils. FIG. 5 shows the magnetic field strength distribution by contour lines. In FIG. 5, Point X is the vertical center position on the inner side of the magnet, and Point X' is the vertical center position on the outer side of the magnet. Point A and Point A' show the upper ends on the inner and the outer sides of the magnet, respectively. The magnetic field intensity shown in FIG. 5 is a magnetic field in the direction indicated by the solid arrow line. That is, the magnetic field is in parallel to the tape plane of the wires wound in a pancake shape.

At a position near the central point (Point X) on the inner side of the magnet, if the target magnetic field is 3 T, for example, 3 T is generated. In FIG. 5, the magnetic field intensity decreases from Point X toward Point X' to be: for example, 2 T at X1; 1 T at X2, and 0.5 T or less at a point outside X3. Also, the magnetic field intensity decreases from the inner side toward the outer side in the vertical direction. As can be seen from FIG. 5, it is clear that the magnetic field is stronger at the inner side at any height of the magnet. In a coil at the same height, the stronger magnetic field is applied at the inner part of the magnet, and the weaker magnetic field is applied at the outer part of the magnet.

Therefore, a superconducting coil of the present invention is formed using a conductor made by electrically connecting the tape-shaped RE123 superconducting wire and the tape-shaped (Bi,Pb)2223 superconducting wire in series in a manner such that the former may be positioned at the inner part where the magnetic field is stronger while the latter may be positioned at the outer part where the magnetic field is weaker.

Figure 6:
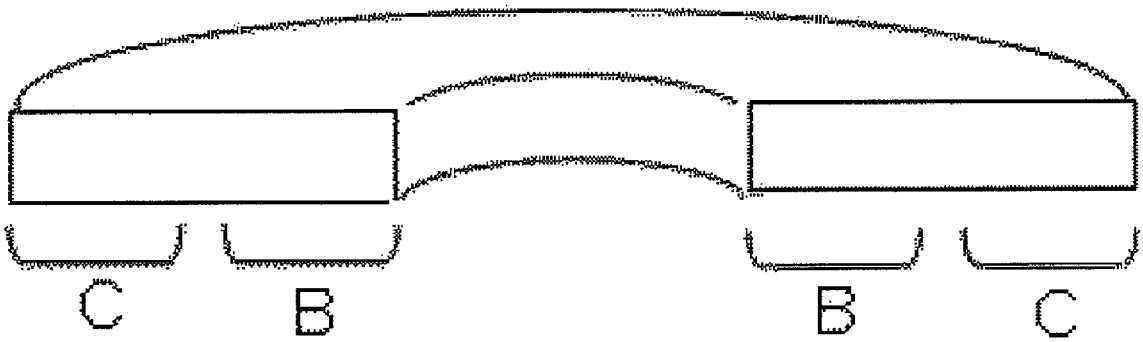
FIG. 6 is a partial sectional perspective view schematically showing the structure of a superconducting coil of the present invention.

FIG. 6 is a partial sectional perspective view schematically showing the structure of a superconducting coil of the present invention. It is a superconducting coil having a pancake shape in which a tape-shaped RE123 superconducting wire and a tape-shaped (Bi,Pb)2223 superconducting wire are connected in series such that the tape-shaped RE123 superconducting wire is wound on the inner side (Part B in FIG. 6) of the superconducting coil while the tape-shaped (Bi,Pb)2223 superconducting wire is wound on the outer side (Part C in FIG. 6) of the superconducting coil.

It is possible to discretionally set, according to the operating conditions (temperature and magnetic field), an extent to which the tape-shaped RE123 superconducting wire be allocated on the inner side of the superconducting coil. In order to form a superconducting coil for generating a high magnetic field, for example, if the operational temperature is low, the tape-shaped RE123 superconducting wire may be arranged in an internal circumferential part that occupies less than half in the radial direction, whereas if the operational temperature is high, the tape-shaped RE123 superconducting wire may be arranged at an internal circumferential part occupying more than half in the radial direction.

Figure 7:
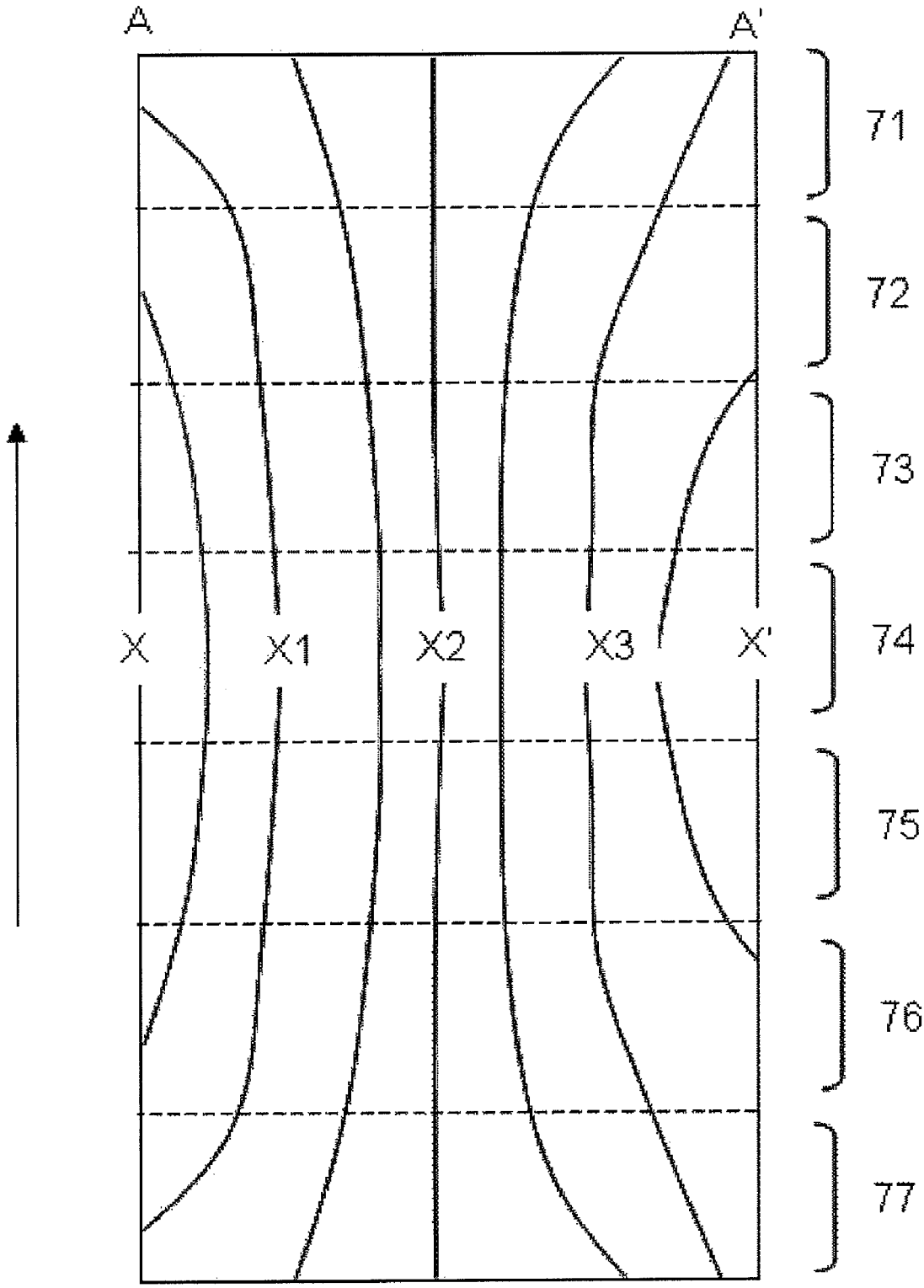
FIG. 7 is a schematic diagram showing a magnetic field strength distribution at a position that corresponds to the A-A' section of FIG. 4 with respect to a superconducting magnet formed of seven superconducting coils.

In the following, an explanation will be given about an example where a superconducting magnet having the magnetic field distribution shown in FIG. 5 is formed from seven pancake-shaped coils. FIG. 7 is a schematic diagram showing a magnetic field strength distribution at a position that corresponds to the A-A' section of FIG. 4 with respect to a superconducting magnet formed of seven superconducting coils. The generated magnetic field at the central point (Point X) is 3 T. The magnet shown in FIG. 7 is composed of seven superconducting coils 71, 72, 73, 74, 75, 76, and 77. The dotted lines in FIG. 7 indicate the boundaries of each of the superconducting coils 71, 72, 73, 74, 75, 76, and 77. The superconducting coils 71, 72, 73, 74, 75, 76, and 77 are electrically connected in series, and an electric current having an identical value flows through each of them. This superconducting magnet is operated maintaining its temperature at 30 K. In the superconducting coil 74 that is arranged at the center, the generated magnetic fields are: 3 T at Point X; 3 T to 1 T at Point X to Point X2; and 1 T or less at the outside of Point X2.

Figure 8:
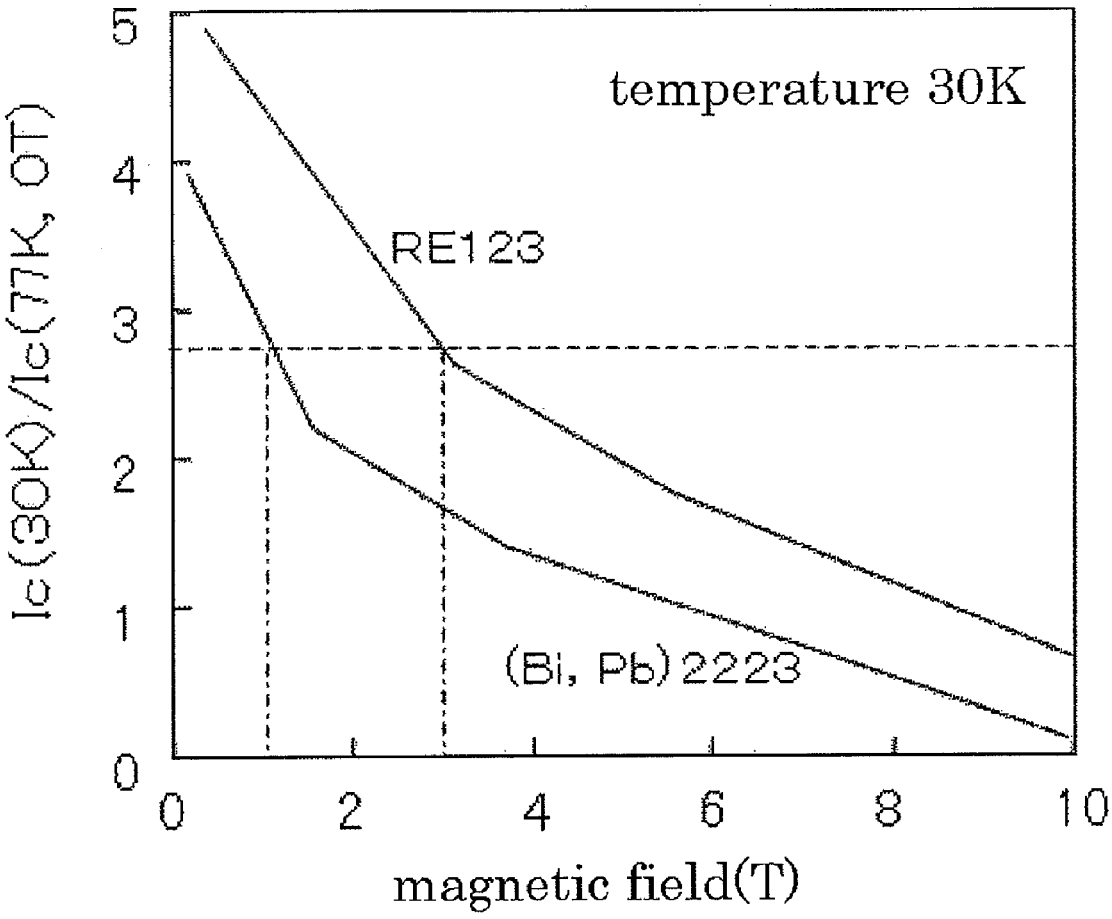
FIG. 8 is a graph showing magnetic field-critical current characteristics of a (Bi,Pb)2223 superconducting wire and a thin-film RE123 superconducting wire at a temperature of 30 K.

FIG. 8 is a graph showing magnetic field-critical current characteristics of a (Bi,Pb)2223 superconducting wire and a thin-film RE123 superconducting wire at a temperature of 30 K. In FIG. 8, as in FIG. 3, where the critical-current value in the zero magnetic field at a liquid-nitrogen temperature (77 K) is 1, the variation of the critical-current value (Ic(30 K)/Ic (77 K, 0 T)) is plotted in the case where a magnetic field of 3 T is applied to the respective tape planes in parallel.

When the tape-shaped (Bi,Pb)2223 superconducting wire and the tape-shaped RE123 superconducting wire which have the same critical-current value in the 77 K and zero magnetic field are used, as can be seen from the magnetic field—critical-current properties in FIG. 8, the critical-current value at a temperature of 30 K is substantially equal for the RE123 superconducting wire placed in a magnetic field of 3 T that is applied in parallel to the tape plane and the (Bi,Pb)2223 superconducting wire placed in a magnetic field of 1 T that is applied in the parallel to the tape plane. This can be understood from the fact that the point of Ic(30 K)/Ic(77 K, 0 T))=2.8 lies at the vicinity of 1 T in the case of the (Bi,Pb) 2223 and at the vicinity of 3 T in the case of the RE123, as shown by a dotted line in FIG. 8.

The superconducting coil 74 which will exhibit such conditions as described above is formed by arranging the tape-shaped RE123 superconducting wire in the area inside of Point X2 and the tape-shaped (Bi,Pb)2223 superconducting wire in the area outside of Point X2. The value of an electric current that can be supplied to a superconducting wire is determined at a part which is placed in the strongest magnetic field. The critical-current value of the tape-shaped RE123 superconducting wire is the lowest at Point X, and the critical-current value of the tape-shaped (Bi,Pb)2223 superconducting wire is the lowest at Point X2. Thus, in the area outside of those points, that is, in the X-X2 region, the tape-shaped RE123 superconducting wire has a critical-current value above the value of Point X, and in the X2-X' region the tape-shaped (Bi,Pb)2223 superconducting wire has a critical-current value above the value of Point X2. Therefore, an electric current (to generate a magnetic field of 3 T at the central part of the magnet) that is below the critical-current value of Point X or Point X2 can be flowed maintaining the superconducting coil 74 in the superconducting state.

According to the magnetic field distribution shown in FIG. 7, it is clear that the other superconducting coils 71, 72, 73, 75, 76, and 77 may be formed by arranging the tape-shaped (Bi,Pb)2223 superconducting wire in an area outside of Point X2 as described above, since the electric current that is the same as the electric current supplied to the superconducting coil 74 flows.

If a superconducting coil that is to be exposed to a magnetic field distribution like the superconducting coil 74 is formed using the tape-shaped (Bi, Pb)2223 superconducting wire only, it cannot be operated at a temperature of 30 K, and it must be cooled to about 20 K. Also, a similar superconducting coil that is made using the tape-shaped RE123 superconducting wire only can operate at a temperature of 30 K. However, such a coil will be expensive because of the high cost of the tape-shaped RE123 superconducting wire. Therefore, by using the tape-shaped RE123 superconducting wire and the tape-shaped (Bi, Pb)2223 superconducting wire in combination like the present invention, it is made possible to make a low-cost superconducting coil that can operate at comparatively high temperature. Moreover, such a coil can be cooled efficiently because the outer part having a larger volume is constituted by the tape-shaped (Bi, Pb)2223 superconducting wire having good thermal conductivity.

In the above-mentioned case, superconducting wires that have an identical critical-current value of the 77 K and zero magnetic field are used. However, it is possible to use wires having different critical-current values of the 77 K and zero magnetic field. In such case, it is possible adopt various arrangements of the wires. For example, in a case where the tape-shaped (Bi,Pb)2223 superconducting wire has a larger critical-current value of the 77 K and zero magnetic field than that of the tape-shaped RE123 superconducting wire, the tape-shaped (Bi,Pb)2223 superconducting wire can be arranged to an inner part beyond Point X2 in FIG. 7. In any variation of the arrangement, the tape-shaped RE123 superconducting wire is always arranged on the inner side of the superconducting coil.

In the present invention, preferably the width of the tape-shaped (Bi,Pb)2223 superconducting wire and that of the tape-shaped RE123 superconducting wire are equal. Generally, when a superconductive magnet is formed by stacking pancake-shaped coils, cooling plates made of metal are arranged between adjacent pancake coils so as to transmit temperature from the refrigerator to each interval between the pancake coils. If a coil is formed by combining a tape-shaped (Bi,Pb)2223 superconducting wire and a tape-shaped RE123 superconducting wire which are different in their width, the coil will have a shape having irregularities in the height level of the bottom face in which the height level of the inner side position does not match the height level of the outer side position. In such a case, in order to cool such a coil, it will be necessary to prepare a cooling plate having a step-like face according to the difference in the height level, and the structure will become complicated.

Also, preferably a superconducting coil is formed by winding a conductor, which is made of a tape-shaped (Bi,Pb)2223 superconducting wire and a tape-shaped RE123 superconducting wire that are electrically connected in series, such that the winding diameter of the tape-shaped RE123 superconducting wire includes all the internal circumferential part within the scope less than the allowable bending diameter of the tape-shaped (Bi,Pb)2223 superconducting wire.

The critical-current value decreases if a wire is wound with a small winding diameter, regardless of whether it is a tape-shaped (Bi,Pb)2223 superconducting wire or a tape-shaped RE123 superconducting wire. Herein, the term "allowable bending diameter" means a winding diameter that exhibits less than 95% of the initial critical-current value when a wire is wound in a direction perpendicular to the tape plane. The allowable bending diameter of the tape-shaped (Bi,Pb)2223 superconducting wire having a thickness of about 0.25 mm, which is generally used, is about 70 mm. Likewise, the allowable bending diameter of the tape-shaped RE123 superconducting wire having a thickness of about 0.1 mm, which is generally used, is about 10 mm.

In a case where a very strong magnetic field is to be generated, a superconducting coil is formed by an increased number of winding with a smaller winding diameter on the premise that the operation is done at about liquid-helium temperature. For example, for making a superconducting coil in which the diameter of the space of magnetic field to be generated is about 20 mm, the diameter of the internal circumferential part of such superconducting coil is less than the above-mentioned allowable bending diameter of the tape-shaped (Bi,Pb)2223 superconducting wire having a thickness of about 0.25 mm, and hence it is impossible to arrange the tape-shaped (Bi,Pb)2223 superconducting wire without degrading the critical-current value.

In the case where such a superconducting coil as the above-mentioned one is formed, the tape-shaped RE123 superconducting wire should occupy the internal circumferential part within the scope less than the allowable bending diameter of the tape-shaped (Bi,Pb)2223 superconducting wire, and the tape-shaped (Bi,Pb)2223 superconducting wire should occupy the outer circumferential part than that. This will allow making a low cost superconducting coil by arranging the high-cost tape-shaped RE123 superconducting wire only in the necessary part.

Example

Hereinafter, the present invention will be described in more detail based on examples.

Example

Sixty pieces of the tape-shaped (Bi,Pb)2223 superconducting wire, which had a width of 4.3±0.1 mm, a thickness of 0.24±0.01 mm, and a length of 180 m, and sixty pieces of the tape-shaped RE123 superconducting wire, which had a width of 4.30±0.05 mm, a thickness of 0.1±0.002 mm, and a length of 40 m, were prepared. These wires had a critical-current value of 190 A to 200 A at the liquid-nitrogen temperature. Sixty pieces of series conductors were made by soldering one kind of theses wires with the other kind of theses wires at one end of each piece thereof.

These series conductors were laminated with a stainless steel tape having a thickness of 0.1 mm and a polyimide tape having a thickness of about 15 μm for an insulating layer between the constituent superconducting layers. The so-constructed conductors were wound around a bobbin from the side of the tape-shaped RE123 superconducting wire such that the tape-shaped RE123 superconducting wire was arranged in the internal circumferential part and the tape-shaped (Bi,Pb)2223 superconducting wire was arranged at the outer circumferential part. In this manner, sixty pancake coils each having an inner diameter of 80 mm, an outer diameter of about 270 mm, and a height of about 4.3 mm were prepared.

The 60 pancake coils thus prepared were stacked and the intervals of the coils were joined. The pancake coils were each electrically insulated by interposing a glass-fiber reinforced plastic sheet having a thickness of 0.1 mm between them. Copper sheets as a cooling plate were arranged between the coils and on the top and bottom surfaces of stack of the coils. These copper sheets were connected with a cold head of a refrigerator through a heat conductive bar so that each coil was cooled. The stack of the superconducting coils was placed in an insulated vacuum vessel. It was possible to arbitrarily set the temperature of the entire superconducting coils to about 10 K by adjusting the output of the refrigerator The temperature of the entire superconducting coils can arbitrarily be set to about 10 K by adjusting the output of the refrigerator.

Comparative Example

A superconducting coil having the same inner diameter and height as in Example and an outer diameter of about 300 mm so as to have the same number of turns as in Example was prepared using only the tape-shaped (Bi,Pb)2223 superconducting wire used in Example, and the cooling thereof is performed in the same manner as in Example.

The current-carrying properties of the coils of Example and Comparative Example that were cooled to various temperatures were investigated. The test method was as follows. The flowing current supplied to the superconducting coils was made zero beforehand and the output of the refrigerator for the superconducting coils was controlled to an equilibrium state (initial state) so that it was possible to maintain the superconducting coils at the respective temperatures. From the initial state, an electric current of 70 A or 100 A was supplied to the superconducting coils for 5 minutes. The magnetic field generated in the superconducting coils changed according to the amount of the flowing current. A voltage, which was determined by the temperature, the magnetic field, and the electric current, occurred in the superconducting coils. The temperature of the superconducting coils changed according to the heat caused by the voltage that occurs in the superconducting coils. The variations of the temperature were measured. The position of measuring the temperature was the internal circumferential part of the top surface of the stack of the superconducting coils. The results of the current-carrying properties test was shown in Table. The magnetic fields shown in Table were values at the central point of the superconducting coils.

TABLE

| | Temperature 10 K. Flowing current/ Central magnetic field | | Temperature 20 K. Flowing current/ Central magnetic field | | Temperature 30 K. Flowing current/ Central magnetic field | | Temperature 40 K. Flowing current/ Central magnetic field |
|---|---|---|---|---|---|---|---|
| | 70 A/6 T | 100 A/9 T | 70 A/6 T | 100 A/9 T | 70 A/6 T | 100 A/9 T | 70 A/6 T |
| Example | 10 K | 10 K | 21 K | 22 K | 31 K | 32 K | 42 K |
| Comparative Example | 10 K | 11 K | 22 K | 23 K | 32 K | 40 K | 53 K |

There was little increase in the temperature in both of Example and Comparative Example, with respect to energizing by 70 A or 100 A at temperatures of 10 K and 20 K. In other words, since the temperature was low, the critical-current value was sufficiently high for either of the wires. Accordingly, the operating current was sufficiently small as compared with the critical-current value, and consequently the generated voltage and the heat caused thereby were small. If the superconducting coils are cooled to a temperature of 20 K or less, it is possible to generate a magnetic field of about 9 T even in the case where only the tape-shaped (Bi,Pb)2223 superconducting wire is used.

On the other hand, at a temperature of 30 K or more, the temperature rise was smaller in Example as compared with Comparative Example. This was because the critical-current value of the tape-shaped (Bi,Pb)2223 superconducting wire in the magnetic field decreases and consequently the operating current became substantially equal to or more than the critical-current value, which resulted in generation of a large voltage, thereby generating heat. Therefore, it is understood that for use at a comparatively high temperature such as 30 K or 40 K, preferably a superconducting coil should be formed using such a conductor as the present invention.

It should be noted that the embodiments and examples disclosed herein are illustrative and are not restrictive in all aspects. It is intended that the scope of the present invention be defined, not by the above description, but by claims, equivalents to the claims, and modifications within the scope thereof.

INDUSTRIAL APPLICABILITY

As described above, the present invention can provide a superconducting coil which is capable of generating a strong magnetic field at comparatively high operation temperature.

The invention claimed is:

1. A superconducting coil shaped as a ring comprising:

a tape-shaped (Bi,Pb)2223 superconducting wire; and a tape-shaped RE123 superconducting wire, the tape-shaped (Bi,Pb)2223 superconducting wire and the tape-shaped RE123 superconducting wire being electrically connected in series, wherein the tape-shaped (Bi,Pb)2223 superconducting wire is arranged in the outer circumferential part of the ring, and the tape-shaped RE123 superconducting wire is arranged in the internal circumferential part of the ring.

2. A superconducting coil as defined by claim 1, wherein the width of the tape-shaped (Bi,Pb)2223 superconducting wire and the width of the tape-shaped RE123 superconducting wire are equal.

3. A superconducting coil as defined by claim 1, wherein the tape-shaped RE123 superconducting wire is arranged such that the winding diameter of the tape-shaped RE123 superconducting wire includes all the inner circumferential part of the ring lying within the scope less than the allowable bending diameter of the tape-shaped (Bi,Pb)2223 superconducting wire.

4. A superconducting conductor including at least one coil as defined by claim 1.

5. A superconducting coil as defined by claim 2, wherein the tape-shaped RE123 superconducting wire is arranged such that the winding diameter of the tape-shaped RE123 superconducting wire includes all the inner circumferential part of the ring lying within the scope less than the allowable bending diameter of the tape-shaped (Bi,Pb)2223 superconducting wire.

6. A superconducting conductor including a plurality of coils as defined by claim 1, wherein the coils are stacked to be in contact with each other so that the coils are electrically connected in series.

* * * * *